United States Patent [19]

Katayama et al.

[11] 4,189,969

[45] Feb. 26, 1980

[54] PICKUP UNIT AND PICKUP ASSEMBLY FOR MUSICAL INSTRUMENT

[75] Inventors: Shinji Katayama; Kazuo Murakami, both of Hamamatsu, Japan

[73] Assignee: Nippon Gakki Seizo Kabushiki Kaisha

[21] Appl. No.: 806,356

[22] Filed: Jun. 14, 1977

[30] Foreign Application Priority Data

Jul. 21, 1976 [JP] Japan ..... 51-96063

[51] Int. Cl.[2] ..... G10H 3/00

[52] U.S. Cl. ..... 84/1.14; 84/116

[58] Field of Search ..... 84/1.01, 1.04, 1.06, 84/1.14–1.16, DIG. 24; 310/311, 340, 348, 9.1; 179/1 M

[56] References Cited

U.S. PATENT DOCUMENTS

| | | | |
|---|---|---|---|
| 2,921,494 | 1/1960 | Leslie | 84/1.14 X |
| 3,470,305 | 9/1969 | Martin et al. | 84/116 |
| 3,530,756 | 9/1970 | Chapman | 84/1.15 |
| 3,542,936 | 11/1970 | Babicky | 84/1.06 |
| 3,558,795 | 1/1971 | Barcus | 84/1.1 X |
| 3,685,384 | 8/1972 | Martin et al. | 84/211 |
| 3,712,951 | 1/1973 | Rickard | 84/1.14 |
| 3,983,777 | 10/1976 | Bartolini | 84/1.15 |
| 4,030,396 | 6/1977 | Mariner | 84/1.16 |

*Primary Examiner*—Vit W. Miska

*Attorney, Agent, or Firm*—Ostrolenk, Faber, Gerb & Soffen

[57] ABSTRACT

In a construction of a transducer or pickup unit for musical instruments having strings, a piezo-electric element is fully embedded within a synthetic resin shield block having top crest for supporting strings while projecting electrode terminals outside of the shield block for direct connection to a printed electric circuit, thereby avoiding drawbacks caused by use of electric lead wires in the conventional pickup unit and damage by atmospheric moisture. The pickup assembly has unitary means for collectively carrying the pickup units at precisely uniform intervals, thereby simplifying registration of the pickup units at correct positions relative to the strings and printed electric circuits.

16 Claims, 10 Drawing Figures

PICKUP UNIT AND PICKUP ASSEMBLY FOR MUSICAL INSTRUMENT

BACKGROUND OF THE INVENTION

The present invention relates to a pickup unit and a pickup assembly for musical instruments and more particularly relates to improvements in the construction of a pickup unit and a pickup assembly for musical instruments having strings such as electric pianos and electric guitars in which string vibrations may be converted into electrical pulsations and in turn into sound.

A pickup unit for musical instruments is known, for example, from the U.S. Pat. No. 3,685,384.

In the construction of the conventional pickup unit, electrodes accompanying a piezo-electric element are in general connected to associated electric circuit by electric lead wires lapped or soldered on the electrode terminals of the pickup unit. Use of such electric lead wires in the limited space left above a frame for holding strings in the musical instrument and under a number of strings is inevitably accompanied by drawback such as troublesome work in setting the leads, unexpected contact of the lead wires with the strings, difficult bundling of a number of lead wires and ill influence by noises. In addition, as the piezo-electric element is exposed to the outside atmosphere, the element is apt to experience damage by atmospheric moisture, thereby seriously degrading the operational characteristics of the pickup unit.

In building up the pickup assembly from a plurality of pickup units in the conventional art, the pickup units have to be fixed on the string holding frame of the musical instrument, e.g. on the piano plate, respectively. This requires highly skilled complicated hand work as the pickup units must be precisely registered at prescribed positions with respect to the strings and to the electric circuits and further must be preciseby spaced apart from each other at uniform intervals. Otherwise uneven pressures imposed on different pickup units tend to cause inter-units deviation in the electric outputs thereof.

SUMMARY OF THE INVENTION

It is a general object of the present invention to provide a pickup unit for musical instruments having tone sources producing mechanical vibrations, which is quite free of the drawbacks resulting from use of the electric lead wires in the conventional art.

It is another object of the present invention to provide a pickup unit for musical instruments having strings which is quite free of any damage by atmospheric moisture.

It is the other object of the present invention to provide a pickup assembly for musical instruments having strings in which the limited space left above the string holding frame and under the strings is most effectively utilized.

It is a further object of the present invention to provide a pickup assembly for musical instruments having strings which assures easy, simple but reliable registiation of the pickup units at correct positions, thereby resulting in even outputs from the electric circuits.

In accordance with one aspect of the present invention, the pickup unit comprises a piezo-electric element associated with electrodes and fully embedded within a synthetic resin shield block while projecting only electrode terminals outside. The pickup assembly comprises unitary means for collectively carrying a plurality of pcikup units at prescribed spacing from each other with the electrode terminals of each pickup unit being coupled to corresponding electric input terminals of an associated printed electric circuit.

DETAILED DESCRIPTION OF THE INVENTION

Figure 1:
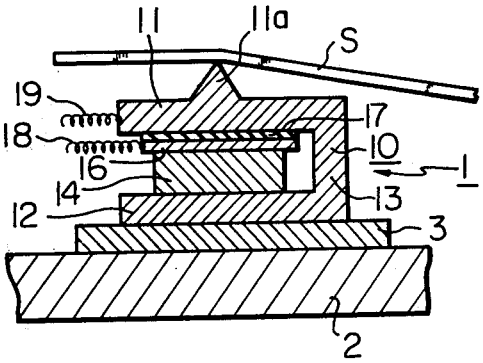
Fig. 1 PRIOR ART
FIG. 1 is a cross sectional side view of a typical example of the conventional pickup unit.

One typical example of the conventional transducer or pickup unit is shown in FIG. 1, in which the transducer or pickup unit 1 comprises an angled C-shaped channel 10 having an upper cantilever arm 11, a base arm 12 and a short arm 13 joining the upper arm 11 to the base arm 12 at one side only while leaving the other side open. A piezo-electric element 14 is inserted between the upper and base arms 11 and 12. The upper arm 11 has a crest 11*a* on the upper surface thereof which is adapted for supporting a string S and itself forms one electrode of the pickup unit 1. The other electrode 16 is inserted between the bottom surface of the upper arm 11 and the top surface of the piazo-electric element 14 via an insulating insert 17. The entire pickup element 1 is fixedly mounted on the piano plate 2 via a base layer 3. The electrodes 11 and 16 are connected to a given electric circuit (not shown) via lead wires 18 and 19.

Figure 2:
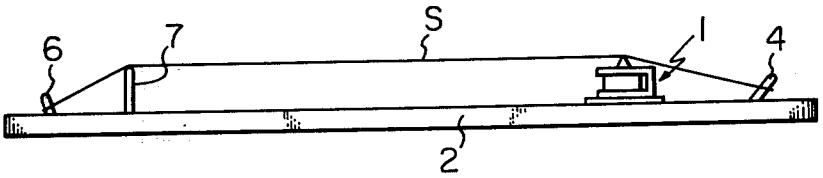
Fig. 2 PRIOR ART
FIG. 2 is a side view of an example of mounting of the conventional pickup unit.

As shown in FIG. 2, the pickup unit 1 is fixedly mounted on the piano plate 2 at a position near a hitch pin 4. The string S is fixed at one end thereof to a tuning pin 6 mounted on the piano plate 2 being properly distant from the corresponding hitch pin 4 and at the other end thereof to the hitch pin 4. The string S is kept in a stretched state over the piano plate 2 while being in pressure contact with a bridge 7 and the crest 11*a* of the pickup unit 1.

As already described in brief, considerably complicated manual work is involved with the conventional pickup unit in lapping or soldering the lead wires to the associated electrodes and connecting the lead wires to the corresponding electric circuit by soldering. These work needs to be carried out from unit to unit. Connection of the lead wires to the electrodes by lapping often induces undesirable contacts of the leads with the string, which apparently gives ill acoustic influence upon tones generated by string vibrations. Presence of a number of strings above the pickup units 1 leaves only a limited space for bundling operation of the lead wires of the required many pickup units and, thus, highly delicate veteran technique is required for finely bundlings the lead wires from a number of pickup units. In addition, relatively long runs of the lead wires connecting the pickup units to associated electric circuits tends to magnify ill influence by noises.

Further, as the piezo-electric element in the conventional transducer or pickup unit is exposed to the outside atmosphere, high moisture in the atmosphere would do damage to the piezo-electric element, thereby causing undesirable change in the operational characteristics and fatal degradation of the function of the piezo-electric element.

Figure 3A:
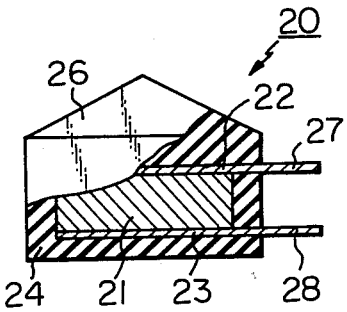
FIG. 3A is a partly sectional side view of an embodiment of the pickup unit in accordance with the present invention.
Figure 3B:
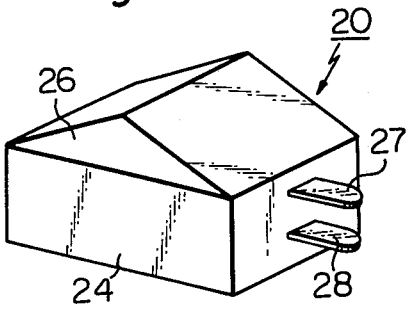
FIG. 3B is a perspective view of the pickup unit shown in FIG. 3A.

One embodiment of the transducer or pickup unit in accordance with the present invention is shown in FIGS. 3A and 3B, in which a transducer or pickup unit 20 comprises a piezo-electric element 21 accompanied by upper and lower electrodes 22 and 23 in such an arrangement that the three elements 21,22 and 23 are fully embedded within a substantially parallelepiped block 24 made of a synthetic resin, which is accompanied with a crest 26 fixed to the top surface thereof. Although the crest 26 is made integrally together with the block 24 in the case of the illustrated embodiment, a wooden or metallic crest may be used as a substitute for the synthetic resin crest to be fixed to the block 24 by the bonding. Electrodes 22 and 23 are both provided with their own terminals 27 and 28 projecting almost horizontally out of the resin block 24 for the later described connection with a given electric circuit.

Figure 4:
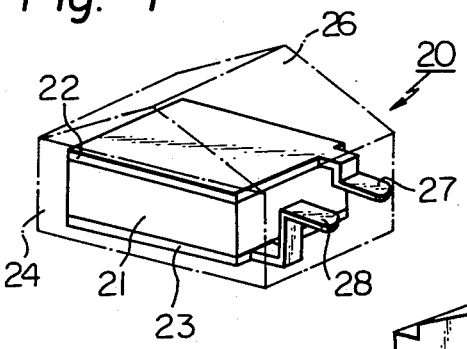
FIG. 4 is an explanatory perspective view of a variant of the pickup unit shown in FIG. 3A.

A variant of the illustrated embodiment is shown in FIG. 4, in which the terminals 27 and 28 are so bent that they are both positioned in a common horizontal plane for convenience in connection with the associated electric circuit.

Figure 5:
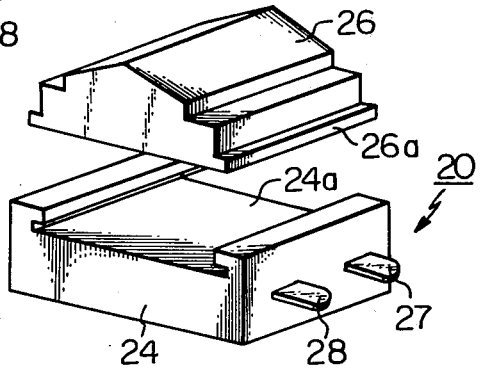
FIG. 5 is a perspective view of a modification of the pickup unit shown in FIG. 3A in a disassembled state.

A further variant of the illustrated embodiment is shown in FIG. 5, in which the crest 26 is provided with a bottom extension 26*a* which should be snugly received in and fixed to a corresponding cutout 24*a* formed in the top surface of the resin block 24.

Figure 6:
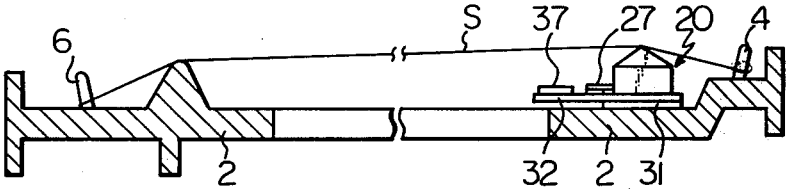
FIG. 6 is a partly sectional side view of an example of mounting of the pickup unit shown in FIG. 3A.

As shown in FIG. 6, the transducer or pickup units 20 having the above-described construction are mounted according to the invention on piano frame or plate 2 via a base board 31 and a printed circuit base board 32 at positions adjacent to the associated hitch pins 4 in such an arrangement that the terminal 27 and 28 of each pickup unit 20 are directly coupled to the corresponding terminals of an associated electric circuit 37 printed on the board 32. Printed circuits serve for effectively utilizing the limited space provided on the piano plate 2 under the strings.

Omission of lead wires used in connection with the conventional transducer or pickup unit aviods the need for troublesome lapping, soldering and bundling operations of the lead wires, thereby greatly simplifying manufacturing of the pickup assemblies. Stably fixed disposition of the terminals on the transducer or pickup unit once the pickup unit is registered at the correct position, succussfully avoids undesirable contact of the terminals with the string. Connection between the pickup unit and the associated electric circuit via the terminals of relatively short construction greatly improves signal-to-noise ratio to be otherwise caused by induction. Further, the overall covering of the piezo-electric element by the moisture impermeable synthetic resin block provides an excellent shield for the piezo-electric element against attack by moisture.

In constructing a transducer or pickup assembly from a plurality of transducers or pickup units, it is also very important to register the pickup units precisely at correct positions with respect to the corresponding strings locating the respective pickup units spaced from each other at prescribed uniform intervals. Fluctuation in intervals between pickup units causes uneven pressures on the piezo-electric elements of the respective pickup units by the strings and such unevenness in the pressure results in fluctuation in the electric output from the pickup units.

Figure 7:
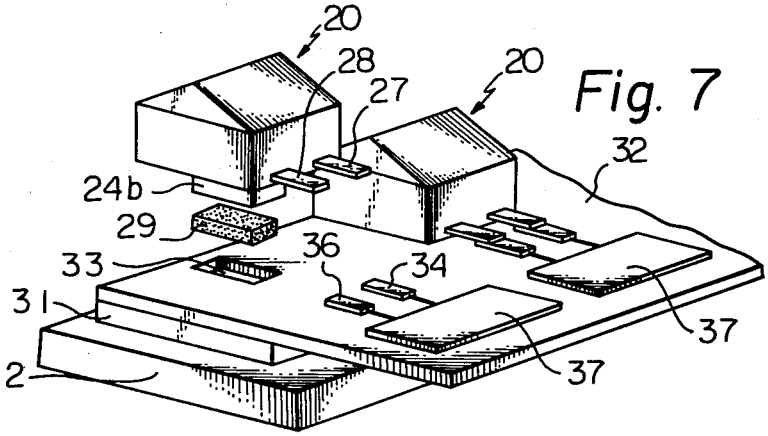
FIG. 7 is a perspective view of an embodiment of the pickup assembly in accordance with the present invention in a partly disassembled state.

One embodiment of the pickup assembly in accordance with the present invention for satisfying such requirement of precisely correct but easy registration of pickup units and electrical connection without lead wires is shown in FIG. 7.

The transducer or pickup assembly 30 comprises the base board 31 fixed on the piano plate 2 and extending in a direction crossing the running direction of the strings and the printed circuit base board 32 mounted on the base board 31 with its one fringe aligned with that of the base board 31. Holes 33 are formed in the top surface of the printed circuit base board 32 while being uniformly spaced from each other along the longitudinal direction of the base board 32. Each of the transducer or pickup unit 20 is provided with a bottom projection 24*b* which is so shaped as to be snugly received within one of the holes 33 formed in the printed circuit base board 32. The pickup units 20 are disposed to the printed circuits base board 32 with the bottom projections 24*b* thereof being snugly inserted into the corresponding holes 33 via suitable cushion inserts 29 so that the terminals 27 and 28 come into contact with corresponding terminals 34 and 36 of printed electric circuits 37 printed or fixed on the base board 32. The terminals 27 and 28 of the pickup unit 20 and the terminals 34 and 36 of the electiric circuit 37 may be soldered respectively with each other for firm fixation therebetween. This soldering operation is far easier than in the conventional pickup unit since the relative positional relationship of each corresponding pair 27 and 34 of the terminals is precisely restricted in advance through the engagement of the projection of the pickup unit 20 with the hole 33 on the base board 32. Further, the terminals 27 and 28 of the pickup unit 20 may be bent downwardly while the terminals 34 and 36 of the electiric circuit 37 may provide bores (not shown) to snugly receive the downward ends of the respective terminals 27 and 28 so that mechanical as well as electrical connection is established between the corresponding terminals of each pair.

Figure 8:
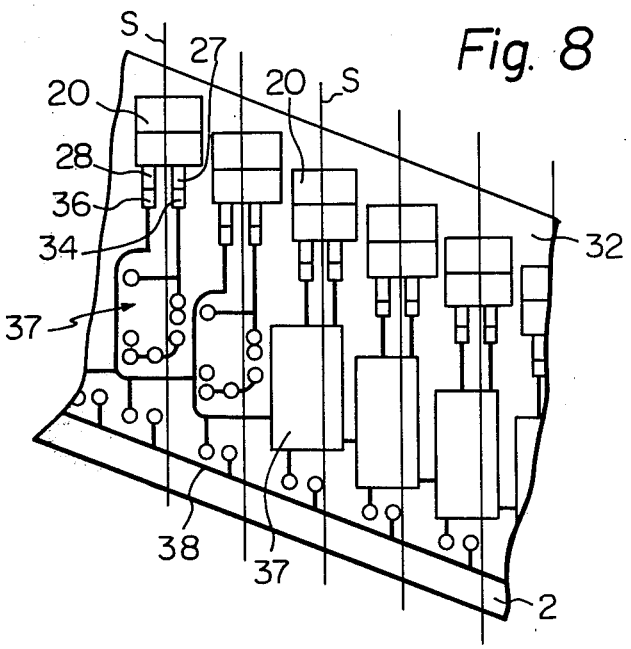
FIG. 8 is a fragmentary top view of the pickup assembly shown in FIG. 7.

One example of the arrangement of the electric circuits 37 is shown in FIG. 8, in which the outputs of the electric circuits 37 are joined to a common printed lead 38 and the string S run in pressure contact with the crests of the respective pickup units 20. Preferably the blocks 24 of the pickup units 20 are made of a relatively hard epoxy-type synthetic resin and the cushion inserts 29 are made of a relatively soft urethane-type synthetic resin. The printed circuit base board 32 may not cover the board 31 but may be fixed to the lateral side of the base board 31. In such a case, the holes 33 should be formed directly in the top surface of the base board 31 as shown in FIG. 9.

Figure 9:
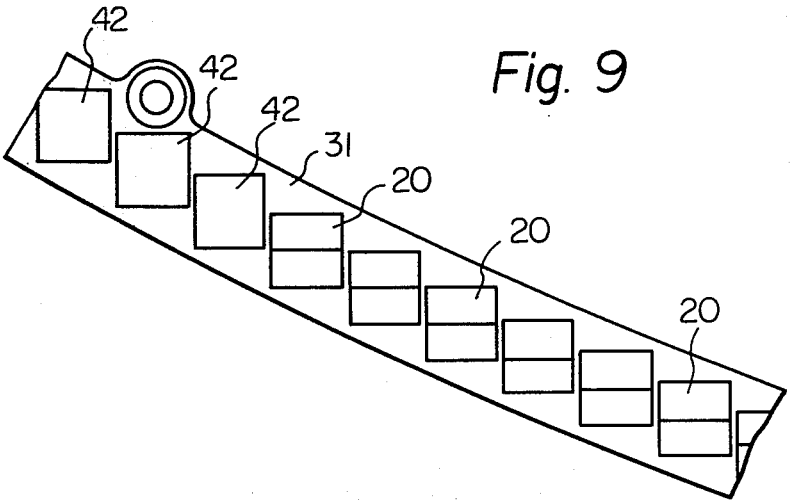
FIG. 9 is a fragmentary top view of a modification of the pickup assembly shown in FIG. 7.

A further simplified construction of the pickup assembly is given by the embodiment shown in FIG. 9, in which holes 42 snugly receptive of the pickup units 20 are formed in the top surface of a base board 31 at prescrived uniform intervals along the length of the board 31. After setting of the pickup units 20 in the holes 42 while leaving crests 26 exposed out of the board 31 as partly shown in the illustration, the base board 31 carrying the pickup units 20 is fixed on the piano plate 2 relative to a printed circuit base board and the strings (both not shown). The board 31 is preferably made of metal, wood or snythetic resin. In some cases, the board 31 may be made of a material composed of longitudinal sections of different damping factors, thereby varying the tone damping rate from range to range of musical notes.

Although the foregoing description is focussed upon the application of the present invention to an electric piano, it should be understood that the present invention can advantageously applicable to any musical instrument having strings or other tone sources such as tone bars where mechanical vibrations may be converted into electrical pulsations, and these in turn into sound by means of a loudspeaker.

For example, the present invention can well be applied to an electric guitar with simple modifications which are quite obvious to ones skilled in the art.

We claim:

1. A pickup unit for a musical instrument having tone sources for producing mechanical vibrations, said pickup unit comprising:

a piezoelectric element having opposite responsive surfaces;

a pair of elongated electrode strips, each being arranged in contact with one of said responsive surfaces and each partly projecting out of the contour of said piezoelectric element and each extending to a respective free end;

a unitary molded shield block, made of synthetic resin, internally and wholly confining said piezoelectric element and said electrode strips thereof in such a manner that said free ends of said electrode strips project out of said shield block to form a pair of output terminals of said pickup unit; and a crest receptive of mechanical vibrations generated by at least one of the tone sources, said crest being disposed atop said shield block in such an arrangement that mechanical vibrations received by said crest are almost all transmitted to said responsive surfaces of said piezoelectric element via said shield block, said crest being releasably coupled to said shield block such that said crest may be removed from said shield block and replaced by a new crest.

2. The pickup unit as claimed in claim 1 in which the projecting ends of said terminals are in a common plane substantially parallel to said top surface of said shield block.

3. The pickup unit as claimed in claim 1 in which said crest is made of a material chosen from a group composed of synthetic resin, metal and wood.

4. The pickup unit as claimed in claim 1, in which said crest has a bottom surface that mates with said top surface of said shield block; said bottom surface of said crest being superposed to the said responsive surface of said piezoelectric element which said bottom surface of said crest engages.

5. A pickup assembly for a musical instrument having tone sources for producing mechanical vibrations, said assembly comprising:

a plurality of said pickup units of claim 13 for converting mechanical vibrations into corresponding electric signals;

a bottom extension formed on each said pickup unit;

a baseboard for supporting said pickup units and having a plurality of holes defined therein, each for receiving a said bottom extension of a respective said pickup unit, thereby holding said pickup units at predetermined positions relative to the tone sources.

6. The pickup assembly as claimed in claim 5, further comprising a respective input terminal for an electric circuit and positioned for electrically engaging and for receiving the electric signal from each respective said output terminal of said pickup unit.

7. The pickup assembly as claimed in claim 5 in which said bottom extension is adapted to be snap coupled into the respective said hole in said baseboard.

8. The pickup assembly as claimed in claim 5, further comprising a respective pair of electric terminals printed on said baseboard near each said pickup unit, and each said electric terminal including an input terminal that contacts the said output terminal of the associated said pickup unit when the said pickup unit bottom extension is in the respective said hole.

9. The pickup assembly as claimed in claim 5, wherein said holes on said baseboard are spaced apart along said baseboard, whereby each said pickup unit is separated from the others.

10. The pickup assembly as claimed in claim 9 in which said holes are spaced apart in the longitudinal direction and the damping ratio of said base board varies in the longitudinal direction thereof.

11. The pickup assembly as claimed in claim 9 in which said bottom extension is adapted to be snap coupled into the respective said hole in said baseboard.

12. The pickup assembly as claimed in claim 11, further comprising a respective cushion insert in each said hole beneath the respective said bottom extension of said pickup unit.

13. The pickup assembly as claimed in claim 7, further comprising a respective pair of electric terminals printed on said baseboard near each said pickup unit, and each said electric terminal including an input terminal that contacts the said output terminal of the associated said pickup unit when the said pickup unit bottom extension is snap coupled in position in the respective said hole.

14. The pickup assembly as claimed in claim 13, further comprising a respective cushion insert in each said hole beneath the respective said bottom extension of said pickup unit.

15. The pickup unit of claim 1, wherein said shield block has a recess formed therein and wherein said crest snugly fits in said recess but may be removed therefrom.

16. The pickup unit of claim 15, wherein said crest has an extension section which fits snugly into said pickup unit.

* * * * *